United States Patent [19]

Ise

[11] Patent Number: 5,069,439

[45] Date of Patent: Dec. 3, 1991

[54] IMAGE FORMING APPARATUS WITH IMPROVED OPERATION PANEL OPERABILITY

[75] Inventor: Satoshi Ise, Machida, Japan

[73] Assignee: Casio Computer Co., Ltd., Tokyo, Japan

[21] Appl. No.: 575,483

[22] Filed: Aug. 30, 1990

[30] Foreign Application Priority Data

Sep. 6, 1989 [JP] Japan ..... 1-104602[U]

[51] Int. Cl.[5] ..... B65H 11/00; B65H 31/00

[52] U.S. Cl. ..... 271/163; 271/213

[58] Field of Search ..... 271/189, 207, 213, 220, 271/163

[56] References Cited

U.S. PATENT DOCUMENTS 3,912,389 10/1975 Miyamoto ..... 271/213 X 4,982,945 1/1991 Marasco ..... 271/213

FOREIGN PATENT DOCUMENTS 56355 2/1990 Japan ..... 271/213

*Primary Examiner*—Richard A. Schacher

*Attorney, Agent, or Firm*—Nixon & Vanderhye

[57] ABSTRACT

An image forming apparatus includes an apparatus body having a casing. An operation panel section is arranged at one side of the casing of the apparatus body. An opening is used to feed sheets of paper from outside into the apparatus body through it or to discharge them outside from the apparatus body through it. A tray has one face and the other face and it is located adjacent to the opening, serving to hold sheets of paper discharged through the opening or to guide them into the apparatus body through the opening. According to this image forming apparatus, the tray can be moved to a position where the one face opposes the surface of the operation panel section of the casing when it is not used, and has an operation section through which the operation panel section of the casing can be operated from the other face when the tray is at that position.

14 Claims, 3 Drawing Sheets

IMAGE FORMING APPARATUS WITH IMPROVED OPERATION PANEL OPERABILITY

BACKGROUND OF THE INVENTION

1. Field of the Invention

The present invention relates to an image forming apparatus such as liquid crystal printers and electrophotographic copying machines and, more particularly, an image forming apparatus wherein a face-up paper sheet discharge opening and an operation panel of the apparatus are formed at a same plane of the apparatus casing.

2. Description of the Related Art

The image forming apparatus such as the liquid crystal printer and the electrophotographic copying machine has usually an operation panel, on which operation keys for enabling the operator to start the image forming operation and to select sizes of paper sheets used and displays for letting the operator know the functions of the apparatus are arranged. The operation panel is usually located on that side (or front side) of the apparatus which is in front of the operator when he is to use the apparatus so as to make it easy to operate the operation panel. A paper sheet supply cassette is further attached to the front side of the apparatus, projecting outside from the apparatus, and a face-up tray is attached to the rear side of the apparatus to swing round a shaft and relative to the apparatus body.

In order to make the apparatus more compact, there has been developed an image forming apparatus in which the operation panel, paper sheet supply cassette and swingable face-up tray all are concentrated on the front side of the apparatus. The most of the paper sheet supply cassette is housed in the apparatus in this case.

In the case of this image forming apparatus of the concentration type, however, the operation panel is shielded by the face-up tray when it is swung to face the operation panel when it is not used, thereby making it impossible to operate operation keys on the operation panel.

SUMMARY OF THE INVENTION

The object of the present invention is therefore to provide an image forming apparatus wherein the operation panel, paper sheet supply cassette and swingable face-up tray all are concentrated on the front side of the apparatus but the operability of the operation panel is improved.

This object of the present invention can be achieved by an image forming apparatus comprising: an apparatus body having a casing; an operation panel section arranged on a side of the casing of the apparatus body; an opening through which sheets of paper are fed from outside into the apparatus body or discharged from the inside of the apparatus body to outside; and a tray having one face and the other face and located adjacent to the opening and serving to hold sheets of paper discharged through the opening or guide sheets of paper into the apparatus body through the opening, wherein when the tray is not used, it can be moved to a position where the one face opposes the surface of the operation panel section of the casing, the tray further having an operation section through which the operation panel section of the casing can be operated from the other face when the tray is at that position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
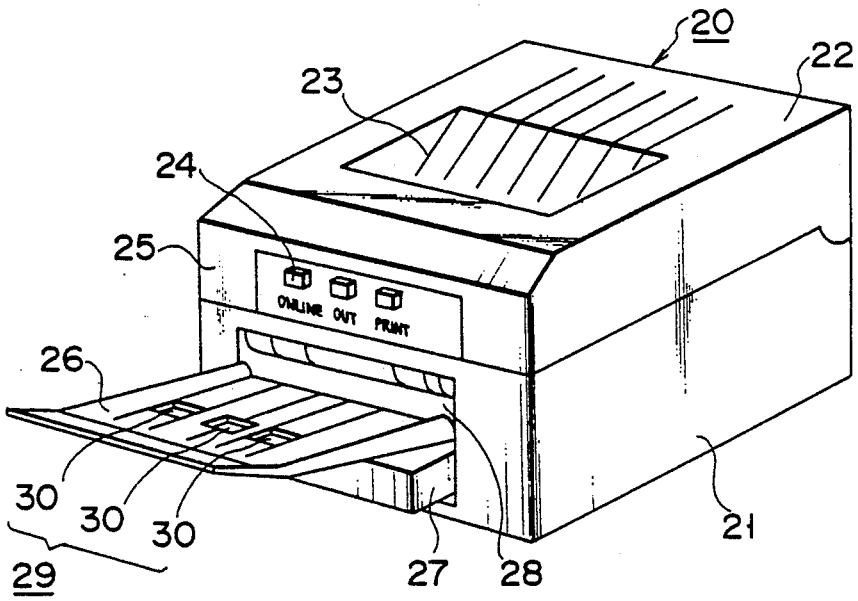
FIG. 1 is a perspective view showing an embodiment of the image forming apparatus according to the present invention.

FIG. 1 is a perspective view showing an embodiment of the image forming apparatus according to the present invention. The image forming apparatus 20 has casing (or apparatus body) 21, which is provided with a lid portion 22 of the shell open type pivoted at one end thereof and swingable round the pivoted shaft. A face-down tray section 23 is formed on the top of the lid portion 22 and an opening (not shown) through which sheets of paper are discharged with their faces down is formed at the bottom of the face-down tray section 23.

An operation panel section 25 where key tops 24 such as switches are arranged is formed on a side wall (or outer area) which is the front face of the casing 21. An opening 28 is formed at the side wall of the casing 21 and under the operating panel section 25 and a face-up tray (or paper sheet tray) 26 for discharging sheets of paper, on which images have been formed, outside the casing 21 from the inside thereof with their faces directed up, and a paper sheet supply tray (or paper sheet supply cassette) 27 are projected outside the casing 21 through the opening 28. Both ends of the base of the face-up tray 26 are pivoted on support member connected to a frame (not shown) which is located a little inward from both vertically-extending sides of the opening 28 and in the casing 21. The face-up tray 26 can be swung round the support member in such a way that it is projected outside the casing 21 through the opening 28 and that it is folded with its face opposed to the surface of the operation panel section 25.

An operation section 29 is formed at that area of the face-up tray 26 which is opposed to the surface of the operation panel section 25 when the tray 26 is folded. The operation section 29 is provided with cutaway portions 30 which correspond to the key tops 24 of switches arranged at the operation panel section 25.

Figure 2:
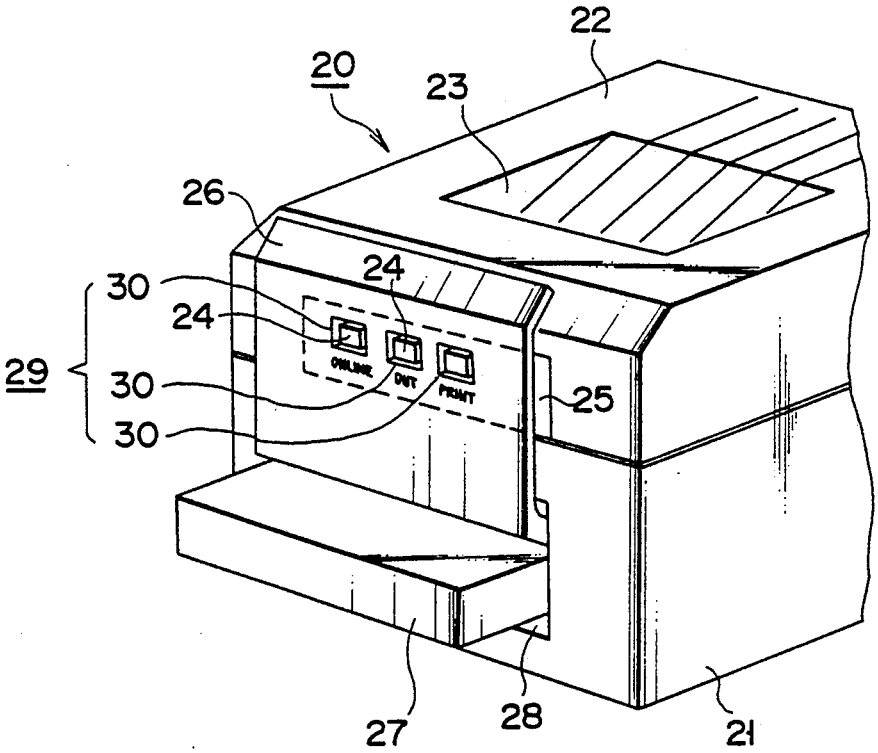
FIG. 2 is a perspective view showing the image forming apparatus of the present invention whose face-up tray is folded.

FIG. 2 is a perspective view showing the image forming apparatus with its face-up tray 26 folded. It may be arranged that same displays as those functional or operational ones such as ON LINE shown adjacent to the key tops 24 of switches at the operation panel section 25 are printed, embossed or transferred adjacent to the cut-away portions 30 at that area of the tray 26 which becomes outside when it is folded. When the whole or that area of the face-up tray 26 which is opposed to the surface of the operation panel section 25 is made of transparent matter such as plastics, the functional displays shown adjacent to the switch key tops 24 on the operation panel section 25 can be made visible directly through the transparent tray 26.

The image forming apparatus of the present invention has the above-described arrangement. Even when the face-up tray 26 is folded, the switch key tops 24 at the operation panel section 25 can be operated through the cut-away portions 30 of the tray 26. In addition, the cost needed to form the above-mentioned cut-away portions 30 at the face-up tray 26 is quite low. Therefore, the forming of these cut-away portions 30 can be easily and economically realized.

Figure 3:
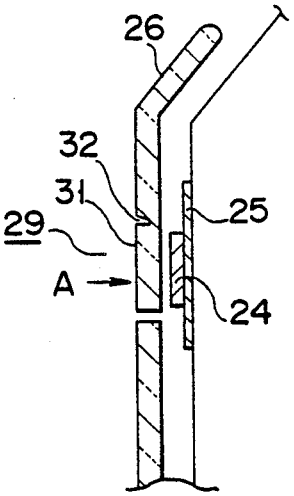
FIG. 3 is a sectional view showing an operation section which is formed as a push section by making a part of the face-up tray movable.

FIG. 3 is a sectional view showing an operation section 29 which is provided, instead of the cut-away portions 30, with push portions (or elastic portions) 31 formed by making those parts of the face-up tray 26 movable, corresponding to the switch key tops 24 at the operation panel section 25. Each of the push portions 31 is slit along its three sides except its top side, and a notch 32 is formed along its top side so as to make the thickness of the face-up tray 26 smaller. When one of the push portions 31 is pushed in a direction shown by an arrow A, it is deflected and deformed along the bottom of the notch 32 to allow one of the key tops 24 to be operated. When the push portions 31 are formed as described above, those sides of each of the push portions 31 which are slit can be reduced so as to prevent sheets of paper from being hooked by these slits.

Figure 4:
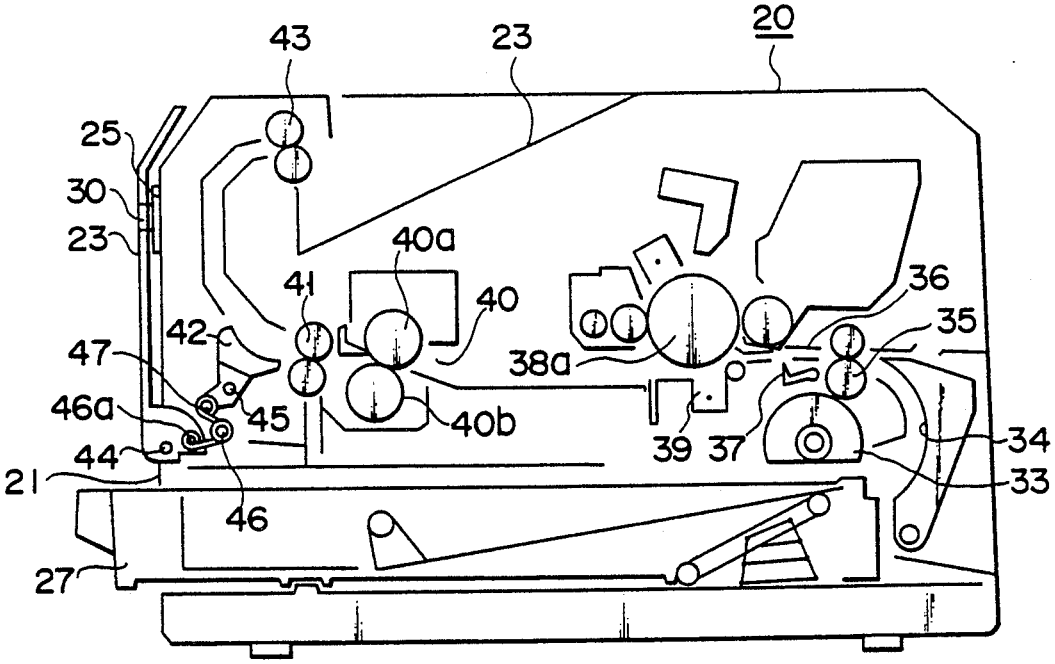
FIG. 4 is a sectional view showing an arrangement in the image forming apparatus of the present invention whose face-up tray is folded.

FIG. 4 is a sectional view showing the image forming apparatus of the present invention kept as shown in FIG. 2. The image forming apparatus 20 is a printer of the reversal paper sheet supply type, which is provided with a paper sheet supply cassette 27 on the bottom thereof. Sheets of paper (not shown) housed in the paper sheet supply cassette 27 are picked up one by one by the rotation of a paper sheet supply roller 33 and fed to feeding rolls (or slip rolls) 35 along a supply guide 34. Sheets of paper thus fed by the rotation of the feeding rolls 35 are reversed in a direction reverse to the direction in which they are fed out of the cassette 27, and fed to a waiting section 36 where front ends of the paper sheets are caught and stopped by a registering plate 37.

The registering plate 37 stops the sheet of paper until a timing at which the front end of a toner image formed on a photosensitive drum 38*a* coincides with the front end of the paper sheet is obtained and when this timing is obtained, the registering plate 37 moves downward. As the result, the sheet of paper is further fed to a transfer means 39 by the conveying rollers 35. The sheet of paper to which image transfer process has been applied is fed to a fixing device 40.

The fixing device 40 has heat and pressure rollers 40*a* and 40*b* and after fixing process, the sheet of paper is fed to the paper sheet discharge side by feeding rolls 41. When a change-over member 42 is at such a position as shown in FIG. 4, the sheet of paper which is fed by the feeding rollers 41 is fed with its upper face downward, in short, its image-transferred face downward and discharged into the face-down tray section 23 through discharge rolls 43.

Both ends of the base of the face-up tray 26 are pivoted on a fulcrum shaft 44 to swing relative to the casing 21, as shown in FIG. 4, and the change-over member 42 for changing over the direction in which the sheets of paper are fed is similarly pivoted on a fulcrum shaft 45 at a position where the feeding direction of paper sheets is changed over, to thereby swing relative to the casing 21. A torsion spring which serves as an urging member 46 is connected to the face-up tray 26 and the change-over member 46 in such a way that one end of the urging member 46 is swingably engaged with a rod 46*a* of the face-up tray 26 while the other end thereof swingably with a rod 47 of the change-over member 42.

Figure 5:
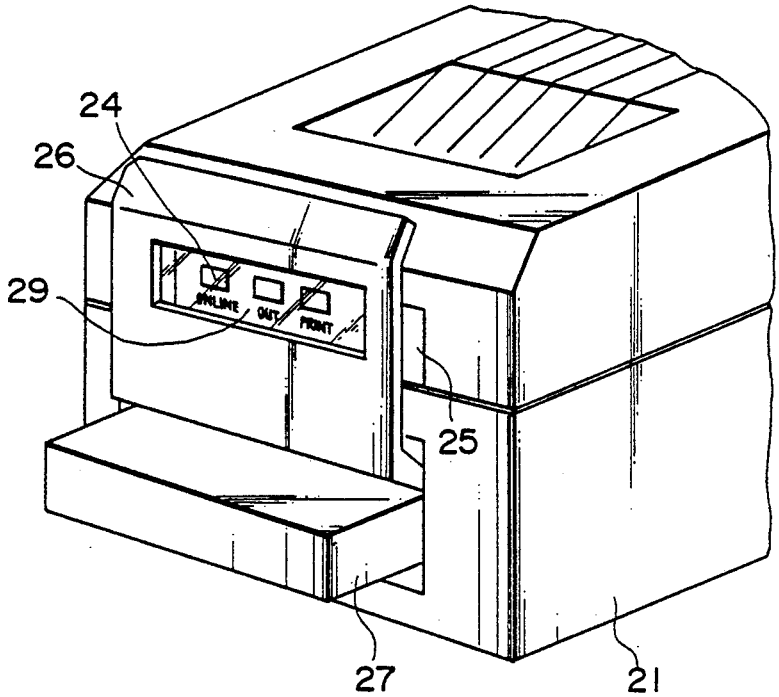
FIG. 5 is a perspective view showing another embodiment of the image forming apparatus according to the present invention.

FIG. 5 is a perspective view showing another embodiment of the image forming apparatus according to the present invention.

The operation section 29 of the face-up tray 26 is provided with a through-hole or rectangular through-hole having such a size that allows the most of the operation panel section 25 to be seen through it. A transparent film such as Mylar plate is stretched to that one side of the rectangular through-hole which becomes back side when the face-up tray 26 is folded by means of bonding, screws and double-face bonding tape. When the key top 24 is pushed by finger with the transparent sheet interposed between them, that portion of the transparent sheet which is pushed by finger is bent by the pressure of finger to thereby operate the key top 24. It may be arranged that a recess having such a depth that equals to the thickness of the transparent sheet is formed along the circumferential rim of the rectangular through-hole and that the circumferential rim portion of the transparent sheet is fitted in the recess. The transparent sheet is thus fixed to the face-up tray 26 and the plane of the face-up tray 26 is made same in level as that of the transparent sheet.

When arranged in this manner, the face-up tray 26 used has nothing by which the sheet of paper is hooked to thereby fulfill the function of the face-up tray itself. When the face-up tray 26 is not used, the key tops 24 can be pushed and operated by finger, seeing them through the transparent sheet. A face-up tray only with the through-hole can also be used, without stretching the transparent sheet.

Figure 6:
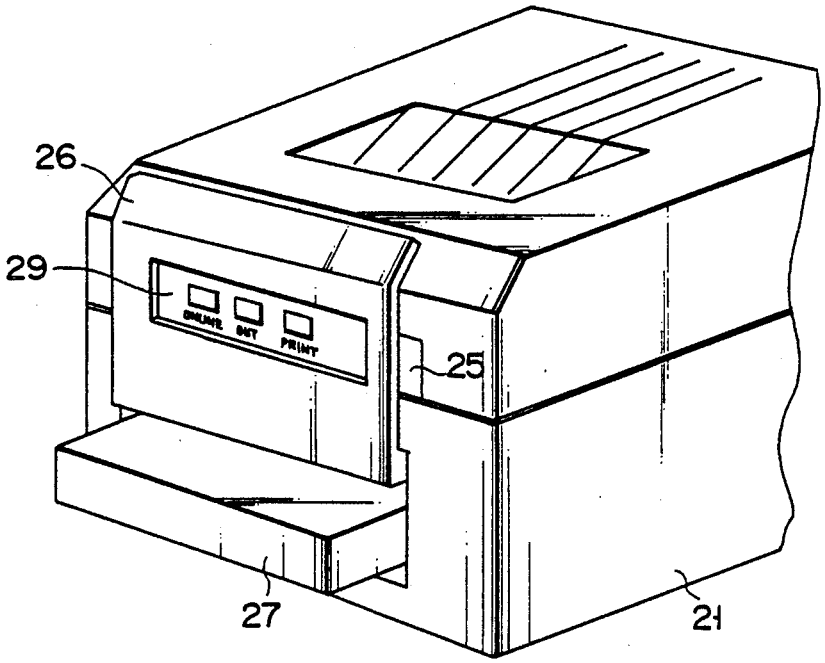
FIG. 6 is a perspective view showing a further embodiment of the image forming apparatus according to the present invention.

FIG. 6 is a perspective view showing a further embodiment of the image forming apparatus according to the present invention.

The operation section 29 of the face-up tray 26 is a through-hole or rectangular through-hole covering the most of the operation panel section 25, as seen in FIG. 5. An opaque sheet member such as an elastic plate made of rubber or soft plastics is stretched to that side of the rectangular through-hole which becomes back side when the face-up tray 26 is folded by means of bonding, screws or double-face bonding tape. Functional displays which correspond to the switch key tops at the operation panel section 25 are printed or shown by transfer paper on the rubber-made plate which becomes front side when the face-up tray 26 is folded.

When the rubber-made plate is pushed by finger, seeing the functional displays which correspond to the key tops at the operation panel section 25, that portion of the rubber-made plate which is pushed by finger is bent to easily operate the key tops. As seen in FIG. 5, it may be arranged that a recess having such a depth that equals to the thickness of the rubber-made plate is formed along the circumferential rim of the rectangular through-hole of the face-up tray 26 and that the circumferential rim portion of the plate is fitted in the recess along the circumferential rim of the rectangular through-hole. The plate is thus fixed to the face-up tray 26 and the plane of the plate is made same in level as that of the face-up tray 26.

When the face-up tray 26 is used, it has nothing by which the sheet of paper is hooked to thereby fulfill its own function as a face-up tray. When it is not used, the plate is pushed by finger to operate the key tops, seeing the functional displays on the plate.

Although the face-up tray 26 has been provided with the operation section 29 in the cases of the above-described examples, the present invention can be applied to the image forming apparatus wherein a tray for manually supplying sheets of paper is used and this tray is provided with the operation section 29. The face-up tray 26 and the manually-operated tray may be freely swingably attached to the apparatus body. Or they may be housed to oppose the face of the operation panel section when they are not used, and they may be fitted into the apparatus body when they are used. Further, the operation panel section and the paper sheet discharge and introducing openings may not be formed at the front side of the apparatus body but the present invention can be applied to these section and openings formed, for example, at other sides of the apparatus.

According to the present invention as described above, the operation section is so formed at the face-up tray as to oppose the operation panel section of the image forming apparatus when the face-up tray is folded. This enables the key tops at the operation panel section to be easily operated. As the result, an image forming apparatus whose operability is excellent can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

an apparatus body having a casing;

an operation panel section arranged on a side of the casing of the apparatus body;

an opening through which sheets of paper are fed from outside into the apparatus body or discharged from the inside of the apparatus body to outside; and a tray having a front face and a back face and located adjacent to the opening and serving to hold sheets of paper discharged through the opening or guide sheets of paper into the apparatus body through the opening, wherein when the tray is not used, it can be moved to a position where the front face opposes the surface of the operation panel section of the casing, the tray further having an operation section through which the operation panel section of the casing can be operated from the back face when the tray is at that position.

2. The image forming apparatus according to claim 1, wherein said operation section of the tray has at least one cut-away portion.

3. The image forming apparatus according to claim 2, wherein said tray has displays on its back face and adjacent to the cut-away portions.

4. The image forming apparatus according to claim 1, wherein said operation section of the tray includes an elastic portion by which the operation panel section of the casing can be operated.

5. The image forming apparatus according to claim 4, wherein said elastic portion is opaque.

6. The image forming apparatus according to claim 5, wherein said elastic portion is like a sheet.

7. The image forming apparatus according to claim 4, wherein said elastic portion is transparent.

8. The image forming apparatus according to claim 7, wherein said elastic portion is like a sheet.

9. The image forming apparatus according to claim 4 wherein said operation panel section has an operation switch and said elastic portion has a display corresponding to this operation switch.

10. The image forming apparatus according to claim 1, wherein said tray serves as a paper sheet discharging tray.

11. The image forming apparatus according to claim 1, wherein said tray serves as a manually-operated tray.

12. The image forming apparatus according to claim 1, wherein said tray can freely swing between a position where it is used and the position where it is not used.

13. The image forming apparatus according to claim 1, wherein said tray is located at a same side of the casing as the opening is.

14. The image forming apparatus according to claim 1, wherein an inlet into which a cassette for holding sheets of paper is set is formed at a same side of the casing as the opening is.

* * * * *